US005494456A

United States Patent [19]

Kozel et al.

[11] Patent Number: 5,494,456

[45] Date of Patent: Feb. 27, 1996

[54] WIRE-TRAP CONNECTOR WITH ANTI-OVERSTRESS MEMBER

[75] Inventors: Charles A. Kozel, McHenry; Kathleen A. Capilupo, Palatine, both of Ill.

[73] Assignee: Methode Electronics, Inc., Chicago, Ill.

[21] Appl. No.: 316,879

[22] Filed: Oct. 3, 1994

[51] Int. Cl.[6] ..... H01R 4/24

[52] U.S. Cl. ..... 439/441; 439/439

[58] Field of Search ..... 439/439–441, 439/636, 677

[56] References Cited

U.S. PATENT DOCUMENTS

| | | | |
|---|---|---|---|
| 3,138,421 | 6/1964 | Locher et al. | 439/440 |
| 3,324,447 | 6/1967 | Pistey | 439/441 |
| 4,036,545 | 7/1977 | Mysiak et al. | 339/95 |
| 4,275,944 | 6/1981 | Sochor | 439/636 |
| 4,317,609 | 3/1982 | Lapraik | 439/636 |
| 4,725,243 | 2/1988 | Pretchel et al. | 439/395 |
| 4,978,315 | 12/1990 | Edgley et al. | 439/441 |
| 5,015,201 | 5/1991 | Brezee et al. | 439/441 |
| 5,083,937 | 1/1992 | Bogiel et al. | 439/441 |
| 5,083,947 | 1/1992 | Dominique et al. | 439/725 |
| 5,110,305 | 5/1992 | Edgley et al. | 439/441 |
| 5,112,081 | 6/1992 | Bogiel et al. | 439/596 |
| 5,112,235 | 5/1992 | Enomoto et al. | 439/83 |
| 5,174,784 | 12/1992 | Penning | 439/439 |
| 5,324,213 | 6/1994 | Frantz | 439/441 |
| 5,348,496 | 9/1994 | Ludwig | 439/441 |

OTHER PUBLICATIONS

Electronic Engineering, Apr. 1960, p. 17.
Design News, Connector, Apr. 19, 1993, p. 107.
Molex Sale Catalog, Wire Trap—LITE, pp. 31K and 32K.
Schematic, Oct. 26, 1990.

*Primary Examiner*—David L. Pirlot
*Assistant Examiner*—Jill DeMello
*Attorney, Agent, or Firm*—Eddie L. Bishop; David L. Newman

[57] ABSTRACT

A wire-trap connector with a means for protecting the connector's contact from becoming overstressed. The connector housing has a connection passageway for providing access to the contact mounted within the connector. In addition, the connector housing has a release passageway, located separately from the connection passageway, which provides access to the contact. In order to release a wire from the contact, a wire extraction tool is inserted in the release passageway and presses against the contact. During the release of the wire from the connector, the contact has at least one tab projecting from it which will abut against an overstress stop abutment mounted within the connector housing. The restricted travel of the contact during the release of the wire will prevent the contact from becoming permanently deformed.

12 Claims, 2 Drawing Sheets

WIRE-TRAP CONNECTOR WITH ANTI-OVERSTRESS MEMBER

BACKGROUND OF THE INVENTION

This invention pertains to a wire-trap connector, and in particular to a wire-trap connector with a means for protecting the wire-trap connector's wire clamping electrical contact from becoming overstressed.

Wire-trap connectors are widely used for making an electrical connection between an external electrical wire, having a stripped distal end exposing the conductor, and a wire clamping electrical contact located within the connector. Normally, in order to make an electrical connection between the conductor and the clamping contact, the stripped end of the wire is inserted within a wire insertion opening located on the outside of the wire-trap connector. Once the wire is inserted within the connector, the wire clamping electrical contact forms an electrical connection with the wire and prevents the wire's extraction from the connector without the use of a wire extraction tool.

To release the wire from the connector, the wire extraction tool is inserted within a wire release opening located on the outside of the connector. Once inserted, the wire extraction tool pushes against a portion of the clamping electrical contact which causes the release of the wire.

The use of a wire extraction tool, however, may result in damage to the clamping electrical contact. Although the clamping electrical contact is normally made of a conductive metal material which will spring-back into its original shape if bent, the contact may be overstressed if it is pushed too far by the wire extraction tool. If the clamping contact becomes overstressed, it will fail to regain its original shape which is essential in order for the wire-trapping function of the connector to continue to work properly.

Furthermore, while releasing the wire from the connector, the clamping electrical contact may inadvertently grasp onto the wire extraction tool. By grasping onto the wire extraction tool, the tool must be forcefully removed from the connector which will result in permanent damage to the clamping electrical contact.

In addition, wire-trap connectors do not facilitate the testing of an electrical connection between the wire and the clamping electrical contact once the wire is inserted within the connector. Instead, wire-trap connectors only allow the external wire to be tested.

In view of the above, it is an object of the invention to protect the connector's wire clamping electrical contact from being overstressed.

In addition, it is an object of the invention to prevent the wire extraction tool from being grasped by the clamping electrical contact.

It is also an object of the invention to provide for testing of the electrical connection formed between the wire and the clamping electrical contact.

Furthermore, it is an object of the invention to provide for the keying of the wire-trap connector.

SUMMARY OF THE INVENTION

In one form of the invention, a wire-trap connector utilizes a means for protecting the connector's contact from becoming overstressed. The wire-trap connector housing has a connection passageway for providing access to the contact mounted within the connector. In addition, the connector housing has a release passageway, located separately from the connection passageway, which provides access to the contact.

When a wire extraction tool is inserted within the release passageway it will press against the contact and thus cause the release of the wire from the connector. During the release of the wire from the connector, the contact has at least one tab projecting from it which will abut against an overstress stop abutment mounted within the connector housing. The restricted travel of the contact during the release of the wire will prevent the contact from being permanently deformed.

In an embodiment, the invention further provides an adjustably mounted solder tail which protrudes from the contact. The solder tail is either oriented at a right angle to one side of the connector housing or extends perpendicular from the connector housing.

In an embodiment, the invention provides a molded omit that covers the connection passageway located within the connector housing.

In an embodiment, the invention provides for a channel which is located within the connector housing. The overstress stop abutment and/or the release stop abutment are contained within the channel.

In an embodiment, the invention provides for the contact to be retained within the connector housing via a friction fit.

In an embodiment, the invention provides that none of the surfaces of the contact be exposed externally of the connector housing.

Various means for practicing the invention and other advantages and novel features thereof will be apparent from the following detailed description of an illustrative preferred embodiment of the invention.

BRIEF DESCRIPTION OF THE DRAWINGS

There is shown in the drawing a presently preferred embodiment of the present invention, wherein like numerals in the various figures pertain to like elements and wherein.

DETAILED DESCRIPTION OF THE PRESENTLY PREFERRED EMBODIMENTS

Figure 1:
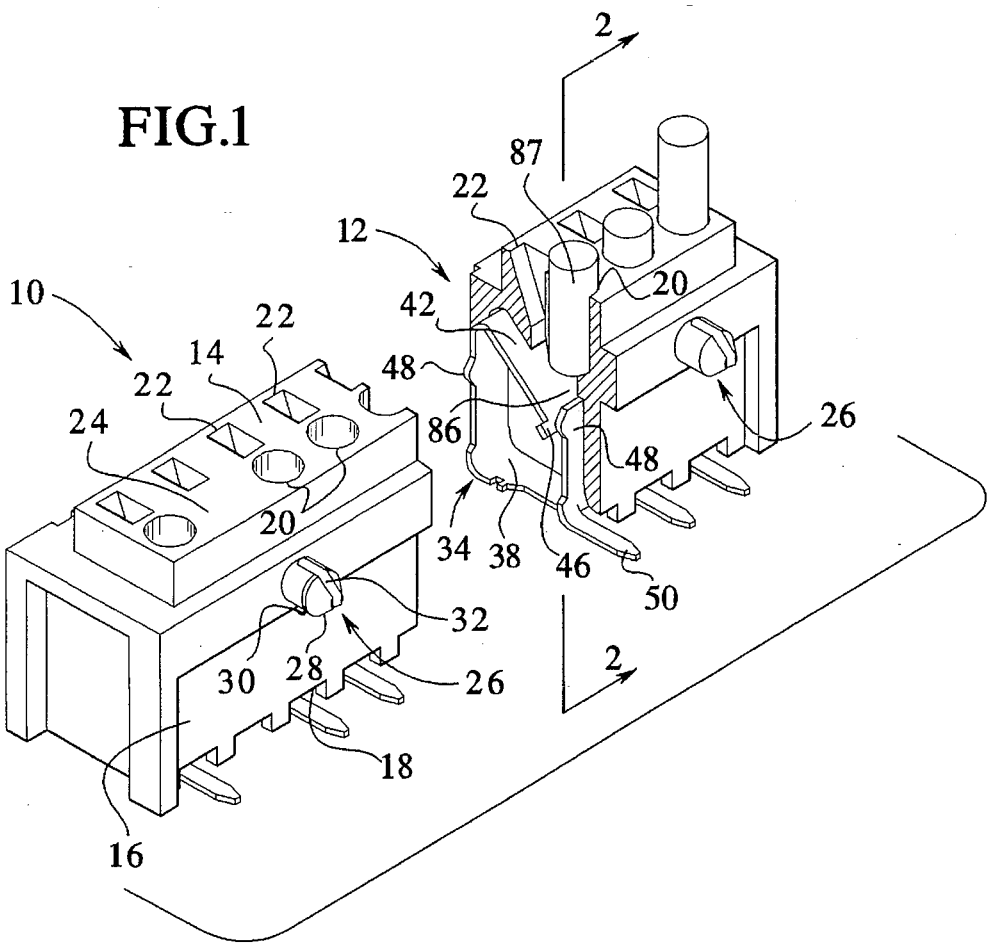
FIG. 1 is an enlarged fragmentary perspective view of a wire-trap connector assembly exposing a connector chamber having an external wire inserted within the chamber.

Referring to the drawing, and particularly to FIG. 1, a fragmentary view of a wire-trap connector assembly 10 is shown with one of its connector chambers 12 exposed. The wire-trap connector 10 is generally rectangular in shape with a first side 14, a second side 16 located adjacent to the first side, and a third side 18 which is opposite the first side.

The third side 18 of the wire-trap connector assembly 10 is uncovered and thus allows access to the bottom of each of the connector chambers 12. This uncovered third side 18 may later be covered for potting, for example, by adding tape or a molded cap member over the third side 18 for such applications as in a ballast apparatus. The uncovered third side 18 allows for insertion of contacts 34 therethrough, which are secured within the housing via a frictional fit.

Conversely, the first side 14 of the wire-trap connector 10 has a plurality of wire insertion openings 20 and wire release openings 22 which are grouped into pairs. Generally, each of the wire insertion opening 20 and wire release opening 22 pairs are positioned at an equal distance from each other. In a preferred embodiment, three (3) to ten (10) pairs of wire insertion openings and wire release openings are present on the connector 10.

To facilitate keying of the connector 10, an omit 24 may be provided on the first side 14 of the connector. The omit 24 consists of a region where normally a wire insertion opening 20 would be provided, but instead the opening has been eliminated.

Positioned on the second side 16 of the connector 10 are two mounting studs 26. Each mounting stud 26 has a tapered distal end 28 with a flange 30 on one side of the stud and a slit 32 along the center. The mounting studs 26 provide for the securing of the connector 10 to a surface of a substrate such as a printed circuit board. The mounting studs 26 in an alterative embodiment of the invention may be located on the third side 18 of the connector, corresponding to the direction of solder tail 50 (See FIG. 4). Furthermore, in yet another embodiment, the mounting studs 26 can be eliminated from the connector 10.

Within the connector assembly 10 are a plurality of connector chambers 12 (only one connector chamber is shown in FIG. 1). Each of the wire insertion opening 20 and wire release opening 22 pairs provide access to a single connector chamber 12. Wire 86 is received into the chamber 12 and protrudes from the first side 14 with wire insulation 87.

Figure 2:
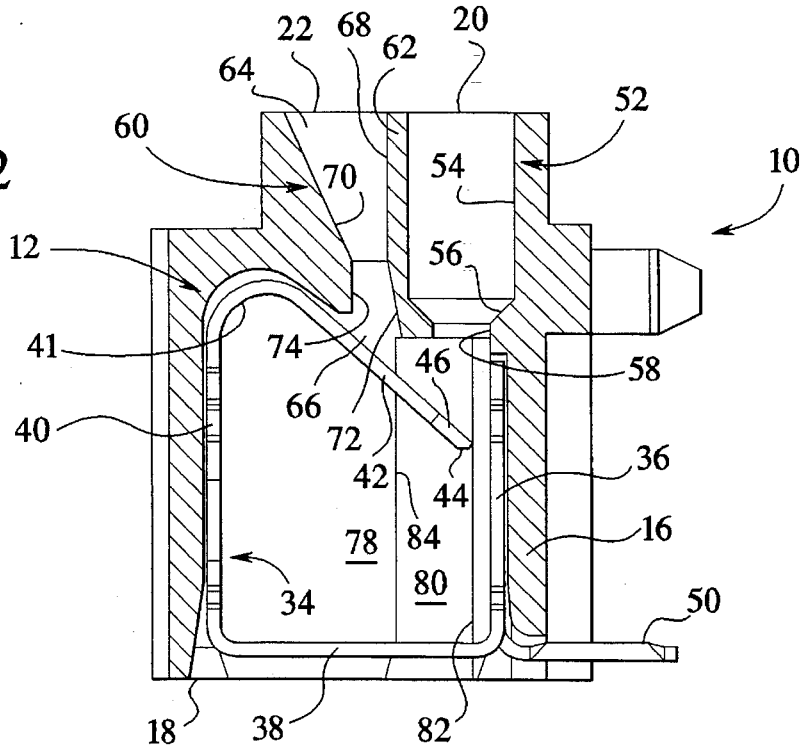
FIG. 2 is an enlarged cross-sectional side view of the wire-trapping connector chamber depicted in FIG. 1, taken at line 2—2, with the external wire removed.

Mounted inside each connector chamber 12 is a contact 34 and more specifically a clamping electrical contact. Referring to FIG. 2, each clamping electrical contact 34 has a main electrical contact 36 mounted adjacent to the second side 16 of the connector 10. Each clamping electrical contact 34 also has a bottom plate 38 which runs along the third side 18 of the connector with one end of the plate connected to the main electrical contact 36 and the other end connected to a side arm 40. The side arm 40 parallels the main electrical contact 36 and connects to a clamping arm 42. The region where the clamping arm 42 connects to the side arm 40 forms a flexible joint 41 which is generally U-shaped. In addition, the clamping arm 42 has a first distal end 44 which is opposite the end connected to the side arm 40.

Located on both sides of the first end 44 of the clamping arm 42 are two tabs 46 (only one tab is shown in FIG. 2). Referring back to FIG. 1, located on both sides of the clamping electrical contact 34 are mounting ears 48, 48 which facilitate the mounting of the clamping electrical contact to the connector 10. The mounting ears 48, 48 provide a friction fit of the contact 34 within the chamber 12. The shape of the contact 34 allows it to be secured within the chamber 12 without any members of the contact 34 having to protrude or be exposed externally to the housing which in prior connectors has caused shorting problems. The connector 10 is preferably constructed of a polyester 94V-0 material which is 15% glass-filled. In addition, it is preferred that the clamping electrical contact 34, including the tabs 46 and mounting ears 48, 48 are a unitary structure stamped and formed of metal material such as phosphor bronze contacts with tin plating.

Figure 4:
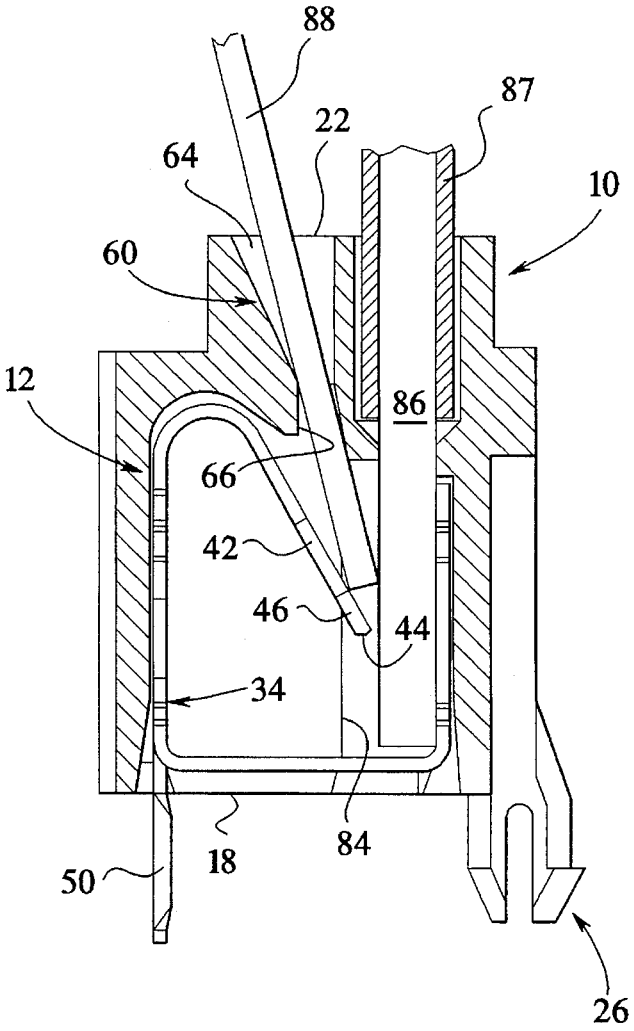
FIG. 4 is an enlarged cross-sectional side view of the wire-trapping connector chamber depicted in FIG. 1, taken at line 2—2, but with a wire extraction tool inserted into the chamber and the mounting studs extending from the third side of the connector.

When the clamping contact 34 is stamped and formed of a single piece of metal material, a solder tail 50 is also stamped and formed so that it will protrude from the connector in an adjustable manner. For example, FIG. 1 depicts the solder tail 50 projecting from the first side 16 of the connector 10 to provide for right-angle mounting of the connector. Similarly, FIG. 4 shows the solder tail 50 projecting directly from the third side 18 of the connector 10 to provide for through board mounting.

Turning back to FIG. 2, the wire insertion opening 20 provides access to the connector chamber 12 by way of a connection passageway 52. The connection passageway 52 consists of a cylindrically shaped wire insertion bore 54, a conical shaped wire guide 56, and a conductor collar 58. One end of the wire insertion bore 54 forms the wire insertion opening 20 and the other end of the bore couples to the large open end of the wire guide 56. The small open end of the wire guide 56 connects to the conductor collar 58. The conductor collar 58 is generally cylindrical in shape and opens into the connector chamber 12. The conductor collar 58 ensures that any conductor inserted into the connector chamber 12 will be positioned adjacent to the main electrical contact 36 of the clamping contact 34. In addition, the diameter of the conductor collar 58 limits the size of the wire 86 which can be inserted into the connector chamber 12 and prevents the non-stripped insulation 87 of the wire from entering the chamber 12.

Similarly, the wire release opening 22 provides access to the connector chamber 12 by way of a release passageway 60. The release passageway 60 is separated from the connection passageway 52 by a partition 62. The release passageway 60 consists of a guide bore 64 and a restrictive bore 66. The guide bore 64 is defined by a separation wall 68 and a sloped guide wall 70. The separation wall 68 parallels the wire insertion bore 54 on the other side of the partition 62. In addition, the sloped guide wall 70 angles towards the separation wall 68 as it approaches the opening of the restrictive bore 66.

Likewise, the restrictive bore 66 adjoins the guide bore 64 and is defined by a sloped restriction wall 72 and a back-pressure wall 74. The back-pressure wall 74 adjoins the sloped guide wall 70, slants towards the center of the connector chamber 12, and extends to the connector chamber. Similarly, the sloped restriction wall 72 adjoins the separation wall 68, angles away from the back-pressure wall 74, and extends to the connector chamber 12.

On both sides of each connector chamber 12 are side walls 78 (only one side wall is shown). Etched within each side wall 78 is a channel 80. Each channel 80 faces the channel located in the opposite side wall 78 and the two sides of the channel 80 are formed by a release stop abutment 82 located adjacent to the main electrical contact 36 and an overstress stop abutment 84 located opposite to the release stop abutment 82 (See FIG. 3).

Figure 3:
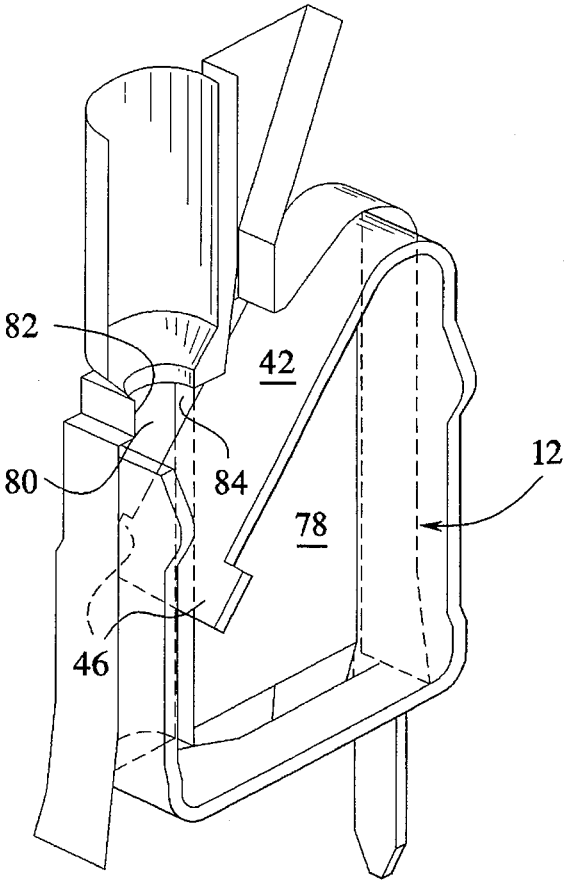
FIG. 3 is a further enlarged schematic view of the wire clamping contact mounted within the connector chamber depicted in FIG. 2.

Turning to FIG. 3, each tab 46 on the clamping arm 42 resides within the channel 80 etched in each of the side walls 78 surrounding the connector chamber 12. As depicted by FIG. 2, with the tab 46 located in the channel 80 of the side wall 78, the travel of the clamping arm 42 is restricted. When no wire is inserted within the connector chamber 12, each tab 46 abuts its corresponding release stop abutment 82. Conversely, when the clamping arm 42 is compressed, it cannot travel past the overstress stop abutment 84 because each tab 46 will abut its corresponding overstress stop abutment 84.

In order to make an electrical connection between the wire clamping electrical contact 34 and an external wire, the exposed conductor of the wire must be inserted within the wire insertion opening 20. As the wire conductor is pushed further into the connection passageway 52, the conductor portion of the wire will pass through the wire insertion bore 54 and be directed by the wire guide 56 into the conductor collar 58. Once the wire 86 enters the connector chamber, it will abut the clamping arm 42 as shown in FIG. 1. As the wire is pushed even further into the connection chamber 12, the clamping arm 42 will be pushed down and away from the release stop abutment 82. The travel of the wire 86 will finally be stopped once it abuts the bottom plate 38 of the wire clamping electrical contact 34.

In order to form a firm electrical connection between the clamping contact 34 and the wire conductor 86, the compressed clamping arm 42 of the wire clamping electrical contact 34 will firmly push the wire against the main electrical contact 36. Furthermore, the clamping contact 34 will pinch the wire between the clamping arm 42 and the main electrical contact 36 in order to prevent the removal of the wire from the connector 10. The sharp edge of the first end 44 of the clamping arm 42 bites against the wire 86 to prevent it from being removed.

As shown in FIG. 4, to release the clamping contact's 34 grip on the wire 86, a wire extraction tool 88 is used. The wire extraction tool 88 is generally cylindrical in shape and is inserted within the wire release opening 22. As the wire extraction tool 88 is pushed further into the release passageway 60, the tool will be directed by the guide bore 64 into the restrictive bore 66. As the tool 88 is pushed further into the connector chamber 12, it will abut the clamping arm 42. The tool 88 will push on the clamping arm 42, which will cause the arm to compress and release its pinching grip on the wire 86.

During the wire release process, however, the clamping arm 42 will be prevented from being overstressed. When the clamping arm 42 is being forced away from the wire 86, each of the tabs 46 on the clamping arm 42 will abut its overstress stop abutment 84 which will prevent the arm from being compressed so much that it becomes permanently deformed.

Furthermore, the wire extraction tool 88 enters the connector chamber 12 and engages with the clamping arm 42 at an converging angle which prevents the sharp edge of the first end 44 of the clamping arm 42 from grasping onto the tool 88.

The positioning and shape of the guide bore 64 and the restrictive bore 66 of the release passageway 60 also allows for effective electrical testing of both the wire clamping electrical contact 34 and the electrical wire 86. If a conductive test probe, or wire extraction tool, is inserted within the connector chamber 12, the probe can be positioned so that it will only form an electrical connection with the wire clamping electrical contact 34, or, alternatively, the probe can be positioned so that it can test both the contact 34 and the wire 86 together.

It should be understood that various changes and modifications to the presently preferred embodiments described herein will be apparent to those skilled in the art. For example, the shape of the wire clamping contact can be formed so that the overstress protection feature does not depend on features located in the connector housing. Instead, the wire clamping contact can be constructed so that it provides its own overstress stop abutment. Such changes and modifications may be made without departing from the spirit and scope of the present invention and without diminishing its attendant advantages. It is, therefore, intended that such changes and modifications be covered by the appended claims.

We claim:

1. A wire-trap connector for forming an electrical connection with a wire conductor, said wire-trap connector comprising:

a) a contact for restricting said wire conductor;

b) a connector housing having a channel; and c) means on the contact for interacting with a wall of said channel, whereby said contact is prevented from being overstressed when said wire is released from said contact.

2. The wire-trap connector of claim 1, wherein said overstress prevention means comprises at least one overstress stop abutment which limits movement of said contact.

3. The wire-trap connector of claim 1, further comprising:

means associated with said housing for allowing testing of said electrical connection between said wire conductor and said contact.

4. The wire-trap connector of claim 3, wherein said testing access means comprises:

a) a connection passageway for providing access to said contact so that said wire can be inserted within said connector and trapped by said contact; and b) a release passageway, located separate from said connection passageway, for providing access to said contact in order to release said wire.

5. The wire-trap connector of claim 1, wherein said contact is shaped from a stamped piece of flat conductive material and further includes an adjustably mounted solder tail having a flat portion which extends from said flat portion of said contact.

6. The wire-trap connector of claim 5, wherein said solder tail is oriented in the same direction as the direction of insertion of the wire.

7. The wire-trap connector of claim 5, wherein said solder tail is perpendicular to the direction of insertion of the wire.

8. An electrical connector comprising:

a) a wire clamping electrical contact for grasping onto a wire, said wire clamping electrical contact having an adjustable mounted solder tail;

b) a connector housing with said wire clamping contact mounted within, and said connector housing having:

i) a connection passageway for providing access to said clamping contact so that said wire can be inserted within said connector and trapped by said clamping contact;

ii) a release passageway, located separate from said connection passageway, for providing access to said clamping contact in order to release said wire; and iii) a channel; and c) at least one tab projecting from said wire clamping electrical contact; and d) at least one overstress stop abutment associated with said channel and abutting said tab during the release of said wire from said wire clamping electrical contact.

9. The connector of claim 8 including a molded omit for providing a visual reference.

10. The connector of claim 9, wherein said molded omit covers said connection passageway.

11. An electrical connector comprising:

a) a wire clamping electrical contact for grasping onto a wire, said wire clamping electrical contact having an adjustable mounted solder tail;

b) a connector housing with said wire clamping contact mounted within, and said connector housing having:

i) a connection passageway for providing access to said clamping contact so that said wire can be inserted within said connector and trapped by said clamping contact;

ii) a release passageway, located separate from said connection passageway, for providing access to said clamping contact in order to release said wire; and iii) a channel within said connector housing; and c) at least one tab projecting from said wire clamping electrical contact; and d) at least one overstress stop abutment within said channel and abutting said tab during the release of said wire from said wire clamping electrical contact.

12. The connector of claim 11, wherein said channel includes a release stop abutment therein.

* * * * *